US006182490B1

(12) United States Patent
Ginzburg et al.

(10) Patent No.: US 6,182,490 B1
(45) Date of Patent: Feb. 6, 2001

(54) SUPER THIN STRIP HOT ROLLING

(75) Inventors: Vladimir B. Ginzburg; Fereidoon A. Bakhtar, both of Pittsburgh, PA (US); Estore Adelino Donini, Vimercate (IT)

(73) Assignees: Danieli Technology Inc., Cranberry Township; International Rolling Mill, Pittsburgh, both of PA (US)

( * ) Notice: Under 35 U.S.C. 154(b), the term of this patent shall be extended for 0 days.

(21) Appl. No.: 09/273,429

(22) Filed: Mar. 19, 1999

(51) Int. Cl.[7] ..... B21B 41/06; B21B 27/06; B21B 39/20

(52) U.S. Cl. ..... 72/229; 72/200; 72/202; 72/252.5

(58) Field of Search ..... 72/200, 201, 202, 72/229, 234, 365.2, 366.2, 252.5

(56) References Cited

U.S. PATENT DOCUMENTS

| | | | | |
|---|---|---|---|---|
| 3,861,188 | * | 1/1975 | Kamit et al. | 72/234 |
| 4,580,428 | | 4/1986 | Brettbacher et al. | 72/226 |
| 5,329,688 | | 7/1994 | Arvedi et al. | 29/527 |
| 5,499,523 | * | 3/1996 | Ginzburg | 72/229 |
| 5,632,177 | | 5/1997 | Narita et al. | 72/249 |
| 5,636,543 | | 6/1997 | Kajiwara et al. | 72/234 |
| 5,647,236 | | 7/1997 | Tippins | 72/8.8 |
| 5,689,991 | | 11/1997 | Kircher | 72/202 |
| 5,752,403 | | 5/1998 | Tippins et al. | 72/229 |
| 5,910,184 | * | 6/1999 | Kneppe et al. | 72/201 |

* cited by examiner

*Primary Examiner*—Rodney A. Butler
(74) *Attorney, Agent, or Firm*—Armstrong, Westerman, Hattori, McLeland & Naughton

(57) ABSTRACT

The present invention is a method and apparatus for the production of thin metal strip by the hot rolling process. Significant improvements in the finished products can be made by the arrangement of the apparatus and the method of the present invention. The apparatus of the present invention is a metal processing line having a roughing reversing mill stand and a finishing reversing mill stand, each with different sized working rolls. A heating furnace precedes each mill stand. The apparatus in the present invention has the advantages of producing desired thin metal strip in the thickness range of about 0.4 to about 1.2 mm at temperatures appropriate for the specific metal being rolled.

19 Claims, 7 Drawing Sheets

SUPER THIN STRIP HOT ROLLING

FIELD OF THE INVENTION

The present invention relates to a method and apparatus for producing thin metal strip in a hot rolling process.

BACKGROUND OF THE INVENTION

The present invention relates to producing thin metal strip by a hot rolling process. More specifically, the present invention is appropriate for producing thin stainless steel strip in a hot rolling process. Since 1950, the production of stainless steel in the western world has been doubling approximately every twenty years. About fifty percent of the total stainless steel production is made up of austenite cold strip. The majority of the austenite cold strip produced is stainless steel 304 (AISI 304). Furthermore, in terms of finished product thickness, the majority of finished product today has a strip thickness predominately in the range of 0.7 to 2.5 mm (millimeters). Based on these figures, there is a need for efficiently producing a stainless steel metal strip, specifically austenite metal strip, having a finished product thickness of about 0.7 to 2.5 mm. The present invention relates to an apparatus and method for producing such a product.

Rolling processes for carbon steel and stainless steels differ because of the differences in mechanical behavior between carbon steels and stainless steels. Stainless steels generally have a lower thermal conductivity at temperatures below about 815° C. than carbon and low-alloy steels. Therefore, heating stainless steels below 815° C. must be done carefully or surface burning will result. Above 815° C. however, stainless steels can be heated the same as carbon steels. For most of the stainless steel grades, the temperature ranges for optimum hot-working characteristics are narrower than those for the carbon steels. Therefore, a close temperature control may be necessary when hot working stainless steels.

Ferritic stainless steels, the iron-chromium stainless steels, are typically very soft when hot, and thus they are easily marked by guides or rolls. Additionally, ferritic stainless steels spread considerably during hot rolling. Overheating these stainless steels can cause excessive metal grain growth, which can make the materials susceptible to tears and cracks.

Austenitic stainless steels, the iron-chromium-nickel stainless steels, are typically stronger than ferritic stainless steels at rolling temperature and thus require more power for deformation. Finishing temperatures which are too low are not practical for austenitic stainless steels because of the power required for deformation. Since austenitic stainless steels are stronger, the amount of reduction per rolling pass is smaller for these stainless steel grades. These steel grades tend to spread less than do ordinary steels.

The temperature of working stainless steels is very important to the finished product. For example, ferritic stainless steels are characterized by two temperature dependent phenomenon that are important in hot rolling. The first of these phenomenon is called roping or ridging. This name signifies the ridges or surface irregularities that form as the result of working ferritic stainless steels. The surface ridges are in the direction of the final cold rolling of the product. It is known that ridging is caused by development of certain textures in the material, following the cold-reduction and annealing operations. Ridging can be reduced by employing high temperatures, for example 870° C. or higher, when working the metal.

The second phenomenon of ferritic stainless steels is the 475° C. embrittlement phenomenon which is a precipitation hardening phenomenon occurring when the ferritic stainless steels are heated in a range of about 370° C. to 540° C. This precipitation hardening can reduce the ductility and toughness of the material. In processing ferritic stainless steels into thin strip by the hot rolling process, it is typically desired to work the material at a temperature above the range of 370° C. to 540° C. in order to avoid the embrittlement phenomenon.

Austenitic stainless steels also have temperature dependent working properties. The temperature of working the austenitic stainless steels will impart certain properties to the hot rolled product. Austenitic stainless steels however, tend to be more stable than ferritic stainless steels during the hot rolling process, in as much as there is no precise embrittlement and ridging temperatures. Nonetheless, at elevated temperatures austenitic steels may be worked into a tough and ductile finished product.

The present invention is an improvement over current hot rolling processes for producing thin strip finished product. The current processes are deficient in that thin metal strip of 0.4 to 1.2 mm cannot be produced with the desired metallurgical characteristics. For example, while U.S. Pat. No. 4,580,428 (1986) discloses a hot rolling mill with a roughing stand and a finishing stand having different sized work rolls. This tandem arrangement of mill stands is not designed for independent temperature controlled roughing and finishing. The roughing stand and the finishing stand are adjacent to each other and are operated in tandem which limits the type of finished product that can be produced from this mill.

Another arrangement for a hot rolling process which has deficiencies for producing a large variety of the possible thin metal strip products is disclosed in U.S. Pat. No. 5,329,688 (1994). This process hot rolls a cast slab at a temperature above 1100° C., followed by a warm semi-finishing rolling of the chilled strip in the temperature range of 250 to 260° C. followed by final cold finishing rolling below 250° C. This type of process, having a series of different temperature rollings, is not desirable for a variety of stainless steels.

Another example of a prior art process for producing thin metal strip by the hot rolling process is disclosed in U.S. Pat. No. 5,689,991 (1997). This process hot rolls thin gauge by using a reversing hot strip mill in combination with a tandem hot strip mill. Again, this arrangement cannot produce the desired thin strip from 0.4 to 1.2 mm in an independently controlled temperature hot rolling process.

The present invention overcomes the deficiencies of the prior art for producing thin metal strip by the hot rolling process.

OBJECTS OF THE INVENTION

It is the principal object of the invention to provide a method and apparatus for the production of thin metal strip having a thickness of about 0.4 to about 1.2 mm.

It is an object of the present invention to provide a method and apparatus for the production of stainless steel thin metal strip having a thickness of about 0.4 to about 1.2 mm.

It is another object of the present invention to provide a method and apparatus that utilizes two mill stands in the production of thin metal strip by the hot rolling process.

It is still another object of the present invention to provide a method and apparatus that performs a second re-heating at temperature in the range of about 850° C. to about 1,000° C., prior to rolling in a finishing mill.

Other objects, features and advantages of the present invention will become apparent from the following detailed description taken in conjunction with the accompanying drawings.

SUMMARY OF THE INVENTION

The present invention is a method and apparatus for the production of thin metal strip by the hot rolling process. Significant improvements in the finished products can be made by the arrangement of the apparatus and the method of the present invention. The present invention is particularly useful for the hot rolling of ferritic carbon steels, ferritic stainless steels and austenitic stainless steels.

The apparatus of the present invention is a metal processing line having a roughing reversing mill stand and a finishing reversing mill stand. A heating furnace precedes each mill stand. A tunnel furnace is typically suited to heat and reheat lengths of metal strip prior to their introduction into either the roughing mill or the finishing mill. Further, the roughing mill stand has work rolls of a larger diameter than the finishing mill stand. This arrangement provides for rolling metal strip at a controlled temperature in two different reversing mill stands and provides for rolling under two different rolling conditions imparted by the different sized work rolls. The apparatus in the present invention has the advantage of producing desired thin metal strip in the thickness range of about 0.4 to about 1.2 mm at temperatures appropriate for the specific metal being rolled.

The method of the present invention includes heating a metal slab; followed by rolling the metal slab in a roughing reversing mill stand having work rolls of a first diameter; reheating the metal strip in a reheat furnace; and rolling the resultant metal strip in a finishing reversing mill stand with work rolls of a second diameter which are smaller than the diameter of the work rolls in the roughing mill. The number of passes in each mill stand will depend on the particular metal being rolled.

By the method of the present invention as well as the arrangement of the apparatus, additional processing steps may be added to the processing line to improve the final product. Namely, a cleaning apparatus may be advantageously inserted between the roughing reversing mill stand and the downstream finishing reversing mill stand. By cleaning the metal product after the roughing process, one can improve the finishing hot rolling process which can ultimately improve the final product.

DETAILED DESCRIPTION OF THE INVENTION

Figure 1:
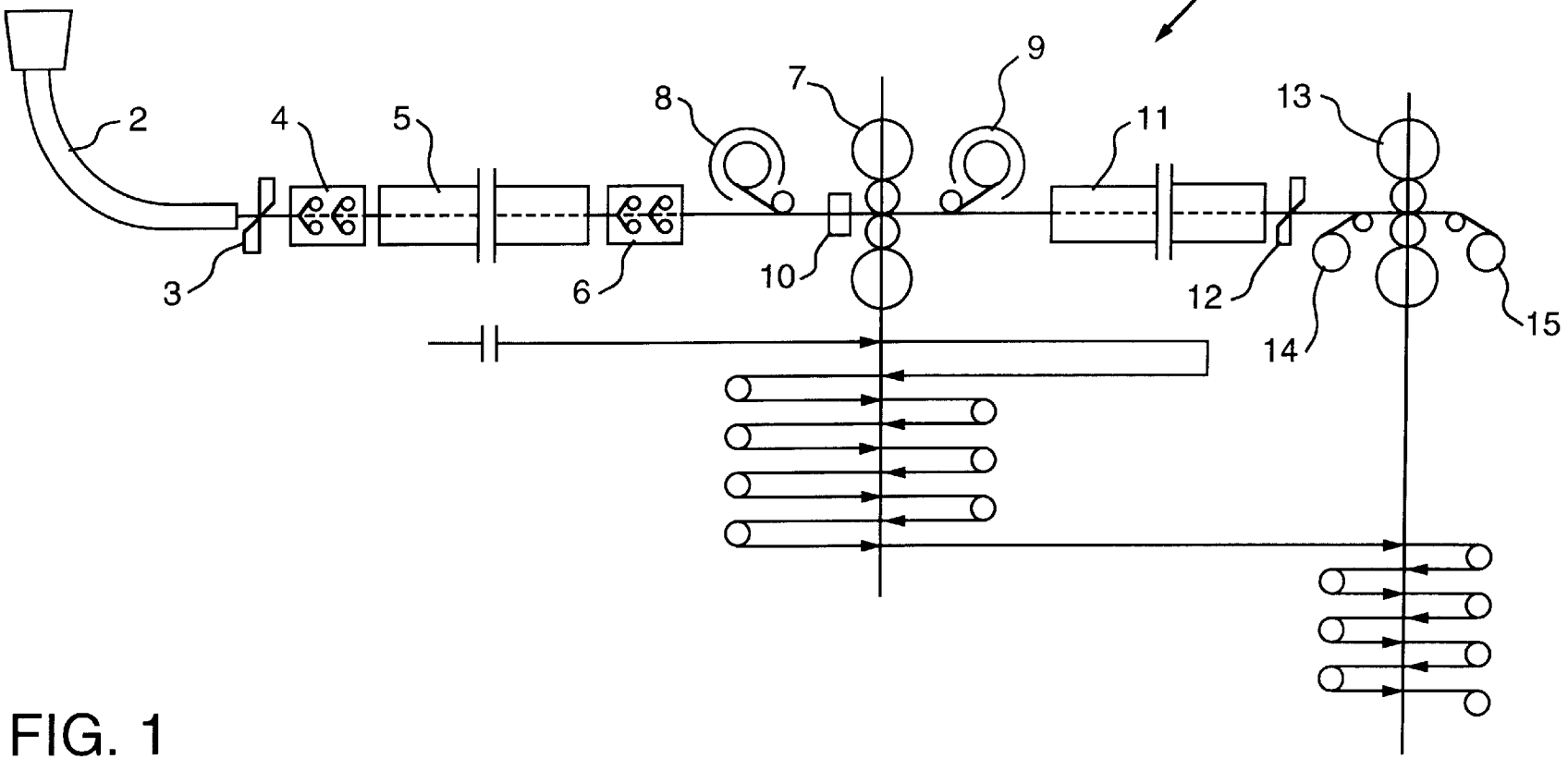
FIG. 1 is a schematic view of a mill for the production of thin metal strip products by the hot rolling process of the present invention with exemplary rolling passes represented by the directional arrows below each reversing mill stand.

The present invention relates to processing mills and methods for the production of thin metal strip by the hot rolling process. In the current state of the art, hot metal strip is rolled in both reversing and tandem hot strip mills down to a thickness of about 1.5 to 15 mm. Some hot strip mills are designed to roll metal strip as thin as 1 mm. However, in the current state of the art, rolling as thin as 1 mm results in a substantial increase of a cobble rate as well as an increase in surface roughness which is not desirable in the finished product. This obviously results in an increase in a number of coils of metal product produced with an inferior flatness.

The present invention is in response to the demand for producing hot rolled metal strip as thin as 0.5 mm. The present invention is practical for rolling steel grades that can be rolled, from metallurgical considerations, below 900° C. In particular, the present invention is suitable for ferritic carbon steels, ferritic stainless steels, and austenitic stainless steels.

The disadvantages of the prior art are overcome in the present invention by adding a heating furnace and a reversing thin strip mill downstream from a roughing reversing hot strip mill. The functions of the two mills can be divided to produce the desired metal product with a more efficient production as well as less wear to the individual mill stands.

The roughing mill, typically a Steckel mill, can receive a hot metal slab from 50 to 100 mm thick and can roll this slab to a strip of a thickness to about 1.5 to about 4 mm, which is in the range for the production of good quality strip by a conventional hot strip mill. To achieve this desired thickness at an efficient rate of speed, the mill, which is typically a single stand mill, utilizes two work rolls with diameters in the range of about 600 to about 800 mm.

Downstream from the roughing mill, having work rolls with diameters from about 600 to about 800 mm, is a furnace for reheating the metal strip followed by a thin strip mill further downstream. The metal strip which exits the roughing mill passes through a furnace, typically a tunnel furnace, for reheating the metal strip prior to being worked in the finishing mill. The thin strip mill receives reheated metal strip having a thickness of about 1.5 to about 4 mm and can reduce this resultant metal strip in several reversing passes to a thickness of about 0.4 to about 1.2 mm. To accomplish this thickness reduction, the thin strip mill utilizes work rolls with diameters from about 300 to about 600 mm. The result of the process is the production of thin metal strip with a thickness of 0.4 to 1.2 mm.

The present invention is advantageous because equipment designed for threading and rolling thin strip, such as entry guides, strippers and expanded mandrels, that are commonly used in cold mills may be used in the apparatus for a hot rolling process. This provides improved strip steering through the apparatus. Additionally, it is advantageous to use larger diameter work rolls for the initial or roughing passes and smaller diameter work rolls for the final or finishing passes of the metal strip. This permits the reduction of the rolling load that would be necessary in a single mill stand and divides the load between two mill stands which ultimately improves the metal strip flatness.

FIG. 1 illustrates the preferred embodiment of the hot strip mill 1 of the present invention. Preceding the hot strip mill 1 of the present invention is a thin slab caster 2, which is typically a curved continuous casting machine with a horizontal run out table for cast metal slabs. Following the thin slab caster 2 is a first shear 3 for cutting or separating the solidified metal slabs into individual lengths of cast slabs. Metal slabs are cut in first shear 3 into individual lengths of slabs for the better handling in hot strip mill 1. After processing the individual slab lengths through hot strip mill 1, the finished product can be welded together prior to coiling in order to form a longer continuous final product. However, for the purposes of handling in hot strip mill 1 the metal slabs are typically cut in first shear 3.

Following first shear 3, in the preferred embodiment of FIG. 1, is first descaler 4, for removing scale from the surface of the cut metal slabs. Scale may be removed by any known process in the descaler 4. After passing through descaler 4, the metal slabs are heated to above about 1,000° C. in first tunnel furnace 5. The temperature to which the metal slab is heated depends on the specific metal being processed. Because the process of the present invention is ideal for ferritic carbon steels, ferritic stainless steels and austenitic stainless steels, a cast slab of these materials is heated to a temperature above about 1,000° C. in tunnel furnace S prior to rolling. The slab is generally heated to a temperature in the range of about 1,000° C. to 1250° C., preferably range of about 1,000° C. to 1200° C. The cast metal slab will exit tunnel furnace 5 at the desired rolling temperature. In the preferred embodiment, downstream from tunnel furnace 5 is second descaler S. Similar to first descaler 4, the metal strip will pass through descaler 6 so that scale may be removed from the surfaces of the metal slab.

After descaling and heating of the cast metal slab, which is typically 50 to 100 mm thick, the heated metal slab will enter a roughing reversing mill 7. The roughing reversing mill 7 of the present invention is typically a single stand reversing mill. In the preferred embodiment it is a four-high mill stand. However, the roughing reversing mill 7 can have other, more numerous, configurations of work rolls and back-up rolls. Roughing reversing mill 7 can have a plurality of work rolls and back-up rolls in a variety of configurations.

The roughing reversing mill 7 of the present invention can be a Steckel mill, for example, and is designed to roll heated cast metal slab that is 50 to 100 mm thick down to metal strip having a thickness of about 1.5 to about 4 mm. Under roughing reversing mill 7 in FIG. 1 nine exemplary roughing rolling passes are shown by the directional arrows. The schematic indicates that the metal slab may be passed nine times through roughing reversing mill 7 to produce a resultant metal strip having a thickness of about 1.5 to about 4 mm.

The cast metal slab is rolled into strip that is about 1.5 to about 4 mm thick because metal strip of this thickness is ideal for further processing in a finishing mill. In the present process, metal strip of about 1.5 to about 4 mm is an intermediate product and therefore this thickness is considered an intermediate thickness in the process of the present invention. The diameter of the work rolls in the single stand in the roughing reversing mill 7 is in the range of about 600 to about 800 mm.

Located proximate to roughing reversing mill 7 is a first coil furnace 8 upstream of roughing reversing mill 7 and a second coil furnace 9 succeeding roughing reversing mill 7. Both first coil furnace 8 and second coil furnace 9 can be used in the reversing rolling process by passing the metal strip back and forth in roughing reversing mill 7 while winding the ends of the metal strip in first coil furnace 8 and in second coil furnace 9. This type of passing in a reversing mill is known as coil passing, as opposed to flat passing where the ends of the metal being rolled in the mill are not wound on coils. Also located proximate roughing reversing mill 7 is edger apparatus 10 which is used to selectively cut the edges and ends of metal strip being processed in roughing reversing mill 7.

Following roughing reversing mill 7 is a second tunnel furnace 11. Second tunnel furnace 11 is for the purpose of reheating the metal strip of the intermediate thickness to a desired temperature, in the range of about 850 to 1,000° C., prior to finishing the metal strip of the intermediate thickness in a finishing mill to produce a metal strip of a final thickness. The produced metal strip of the intermediate thickness exits second tunnel furnace 11 at the desired temperature and typically passes through the second shear 12 where it can be cut to further individual lengths.

After reheating in second tunnel furnace 11 and possibly cutting in the shear 12, the resultant metal strip of the intermediate thickness of about 1.5 to about 4 mm enters a thin strip mill 13. Thin strip mill 13 is a finishing mill and the preferred embodiment is a single stand reversing finishing mill. By reheating the strip in second tunnel furnace 11 to a temperature in the range of about 850 to 1,000° C., the second to last pass in thin strip mill 13 can be performed in the temperature range of about 650 to 800° C. The second to last pass and the final pass of the metal strip can be performed in the range of about 600 to 800° C. By performing the last few passes in thin strip mill 13 at the desired temperature desirable metallurgical properties may be obtained, namely a desired grain size may be obtained in the metal strip.

In the preferred embodiment, thin strip mill 13 is a four-high mill stand. However, the thin strip mill 13 can have other, more numerous, configurations of work rolls and back-up rolls. Thin strip mill 13 can have a plurality of work rolls and back-up rolls in a variety of configurations. The diameter of the work rolls of this strip mill 13 is in the range of about 300 to about 600 mm.

Preceding thin strip mill 13 is a first coiler 14 and succeeding thin strip mill 13 is a second coiler 15. Under thin strip mill 13 in FIG. 1 seven exemplary roughing rolling passes are shown by the directional arrows. The schematic indicates that the resultant metal strip may be passed seven times through thin strip mill 13 to produce a finished metal strip having a thickness of about 0.4 to about 1.2 mm.

First coiler 14 and second coiler 15 are for the purpose of coil passing the metal strip of the intermediate thickness through several reversing passes before it is wound on either first coiler 14 or second coiler 15 as finished product to be removed from hot strip mill 1. Coiler 15 may utilize a collapsing mandrel allowing the removal of the product from the mill in coil form convenient for further processing if necessary.

Surface finish and flatness of rolled stock can be improved when rolling is performed in two separate mill stands with different diameter work rolls. Smaller diameter work rolls require less force than rolls of a larger diameter. This is because the area of contact in small diameter work rolls is less; requiring less force to work metal product in the same manner than larger diameter work rolls. Therefore, in the method of the present invention, the pressure imparted to the strip of the intermediate thickness in the thin strip mill 13 is different than the pressure imparted to the metal slab rolled in the roughing reversing mill 7.

Figure 2:
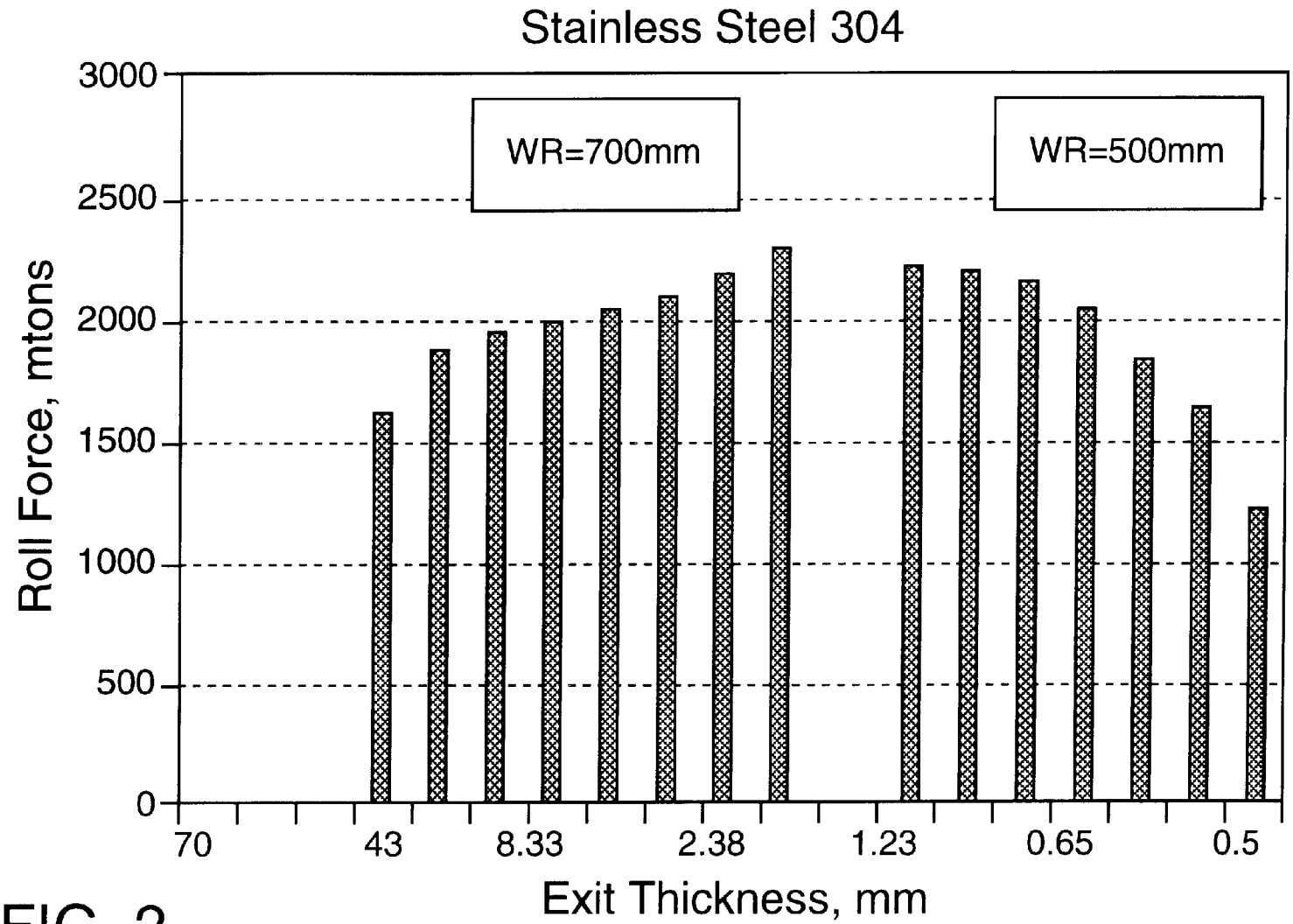
FIG. 2 is a graph showing exit thickness versus roll force of stainless steel 304 (AISI 304) in the hot rolling process of the present invention.

The different metal working pressures and forces used will alter the final finished product and ultimately create an improved product. FIG. 2 illustrates the differences in roll force of the work rolls of roughing reversing mill 7 versus thin strip mill 13. The rolling of stainless steel 304 (AISI 304) is given as example to show the rolling force necessary to produce stainless strip 0.5 mm thick. Using work rolls 700 mm in diameter in the roughing mill, a continual increase in the roll force is necessary to produce the thickness of the metal strip with each rolling pass. Because the contact area of the work rolls is fixed, the roll force will have to be increased in order to increase the force imparted on the metal strip being rolled. However, when the contact area of the work roll is reduced, by reducing the diameter of the work roll to 500 mm in the finishing mill for example, then the amount of roll force necessary to work the metal strip can also be reduced. FIG. 2 shows the reduction in roll force that accompanies a reduction in work roll diameter in the finishing mill.

For the purposes of processing efficiency, it is efficient to separate the steps of roughing and finishing into two separate mills having different sized work rolls. The difference in contact area of the work rolls allows a producer to vary the rolling passes in the different mills, as well as, vary the force required in the roughing mill and the finishing mill to produce metal strip of a desired thickness.

Figure 3:
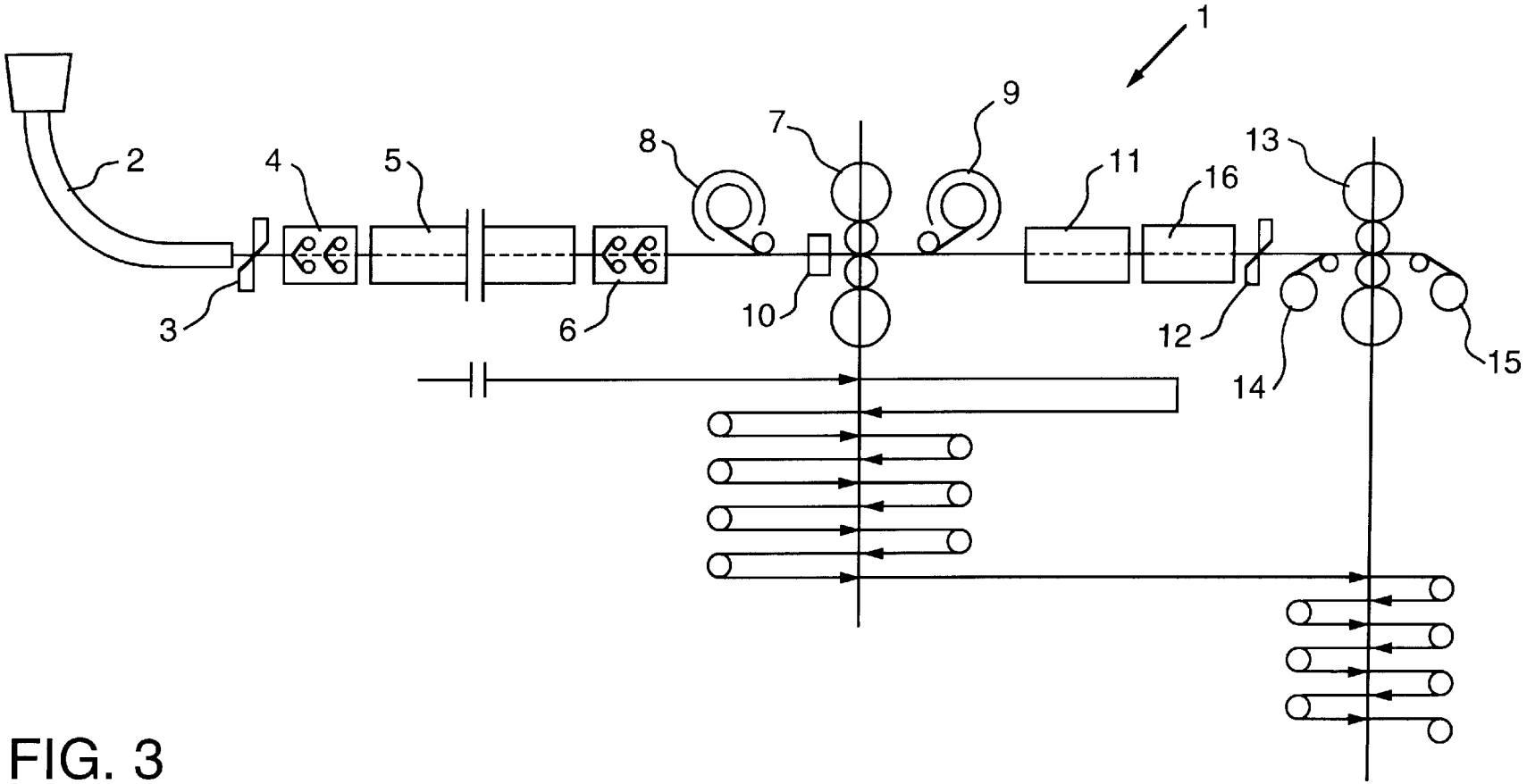
FIG. 3 is a schematic view of a mill for the production of thin metal strip by the hot rolling process of the present invention including a cleaning apparatus between the roughing mill and the finishing mill.

FIG. 3 shows the second embodiment of the present invention. The reference numbers of components of FIG. 3 are the same reference numbers of FIG. 1 and correspond to like parts. The main difference of the second embodiment of the present invention is the inclusion of a cleaning apparatus 16 downstream from roughing reversing mill 7 and upstream from thin strip mill 13. The purpose of cleaning apparatus 16 is to provide an additional and optional step of cleaning the metal strip of the intermediate thickness prior to rolling in thin strip mill 13. This can result in a cleaner final product.

The embodiment of FIG. 1 operates as follows: a metal slab with a thickness from 50 to 100 mm is produced by thin slab caster 2. After shearing, in first shear 3, the metal slab is descaled in first descaler 4 and then it enters the first tunnel furnace 5 for heating. When the metal slab exits first tunnel furnace 5 it is at a temperature above 1,000° C. The metal slab is then descaled again in second descaler 6 prior to entering the edger 10 and the roughing reversing mill 7. Initially, the metal slab is rolled in the roughing reversing mill 7 without coiling until after the thickness is reduced to about 25 to 30 mm. The rolling proceeds with coiling inside the first coil furnace 8 and second coil furnace 9 until the target metal strip thickness of about 1.5 to about 4 mm is achieved.

The metal strip, now a metal strip of an intermediate thickness, is unloaded from roughing reversing mill 7 and passes downstream into the second tunnel furnace 11. Here the metal strip of the intermediate thickness is reheated to a temperature between 850 and 1,000° C.

After exiting second tunnel furnace 11 and cutting the head end of the metal strip of the intermediate thickness by second shear 12, the metal strip enters thin strip mill 13. Before the first pass is completed, the tail end of the metal strip is also cut by the second shear 12. After completion of the first pass, the tail end is coiled on the expanded mandrel of the first coiler 14. The rolling proceeds by coiling on both first coiler 14 and second coiler 15. To avoid problems associated with rethreading the metal strip, the ends, about three wraps, can be retained on the mandrels of the first coiler 14 and the second coiler 15. By reheating the strip in second tunnel furnace 11 to a temperature in the range of about 850 to 1,000° C., the second to last pass in thin strip mill 13 can be performed in the temperature range of about 650 to 800° C. By performing the last few passes in thin strip mill 13 at the desired temperature, desired metallurgical properties, like grain size, may be achieved. The thin strip mill 13 is equipped with control equipment that would be typical for existing cold reduction mills that is superior to the equipment typically used in hot strip mills.

Table I below shows the proposed rolling schedule for rolling AISI 304 stainless steel strip from a 70 mm thick slab. The slab is first rolled in two passes down to 25.4 mm in a Steckel mill, a mill appropriate for the roughing reversing mill of the present invention, without a coiler. After the second pass, the rolling proceeds with coiling, until after the strip of thickness 1.8 mm is achieved. The strip is then rolled in the thin strip mill downstream of the roughing reversing mill, for example the Steckel mill, to a thickness of 0.5 mm.

During the transfer of the strip from the roughing reversing mill to the thin strip mill, there may possibly be a need for stopping the metal strip. To avoid marking the rolls of the roughing reversing mill during these stops, the reduction at the roughing reversing mill during the last pass is reduced to a minimum value so the roughing reversing mill performs during this pass essentially as a pinch roll. FIG. 2 shows a plot of the roll separating forces corresponding to the pass schedule shown in Table I below.

TABLE 1

Rolling schedule for 304 grade stainless steel.

| Steckel mill | | | Thin Strip Mill | | |
|---|---|---|---|---|---|
| Pass no. | Exit thickness, mm | Flat or coiling pass | Pass no. | Exit thickness, mm | Flat or coiling pass |
| Slab | 70.00 | | | | |
| 1 | 43.00 | flat | 1 | 1.23 | coiling |
| 2 | 25.40 | coiling | 2 | 0.93 | coiling |
| 3 | 14.50 | coiling | 3 | 0.76 | coiling |
| 4 | 8.33 | coiling | 4 | 0.65 | coiling |
| 5 | 5.08 | coiling | 5 | 0.58 | coiling |
| 6 | 3.35 | coiling | 6 | 0.53 | coiling |
| 7 | 2.38 | coiling | 7 | 0.50 | coiling |
| 8 | 1.80 | coiling | | | |
| 9 | 1.80 | flat | | | |

Figure 4:
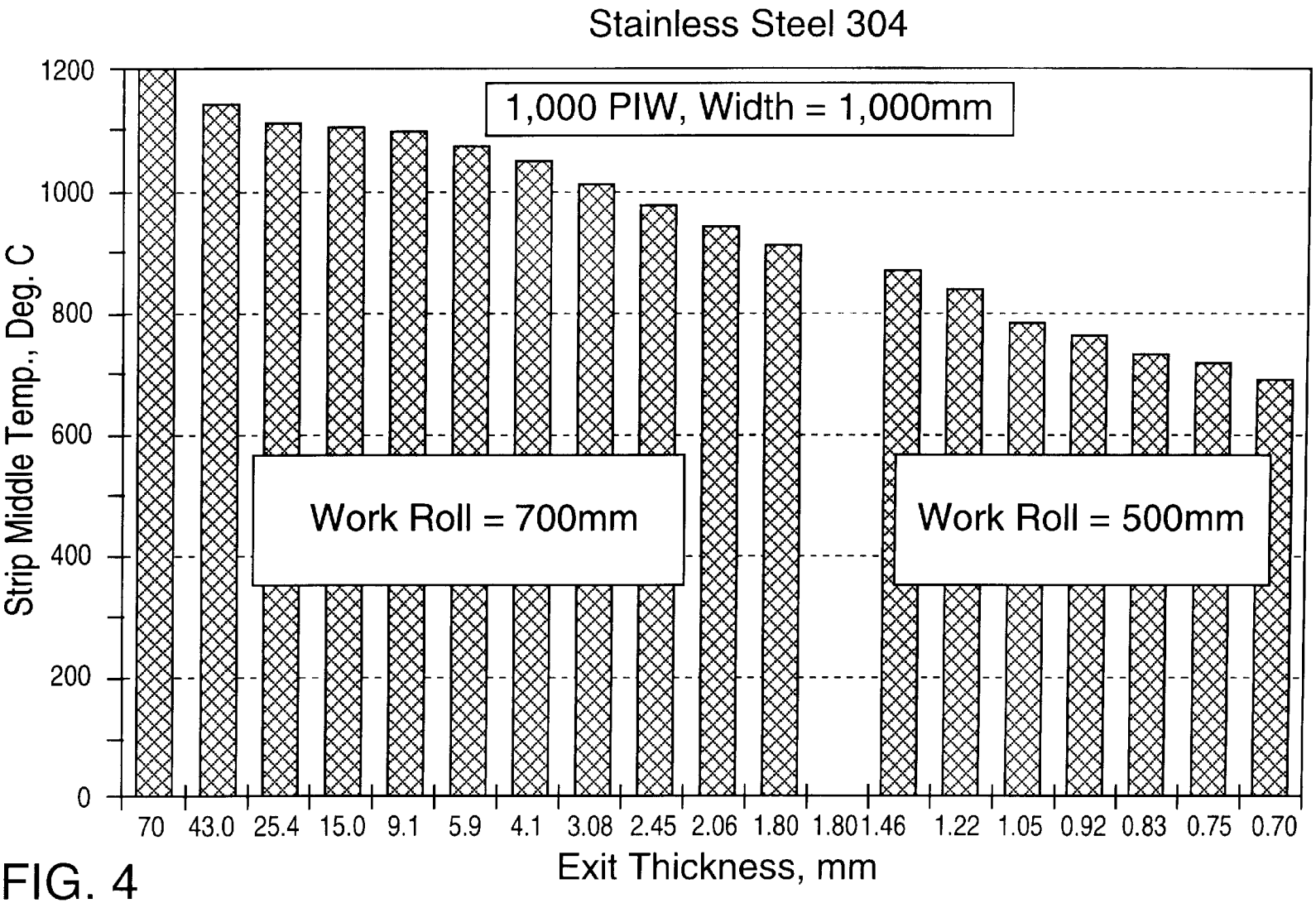
FIG. 4 is a graph showing exit thickness versus strip metal temperature of stainless steel 304 (AISI 304) in both the roughing mill and the finishing mill of the present invention.
Figure 5:
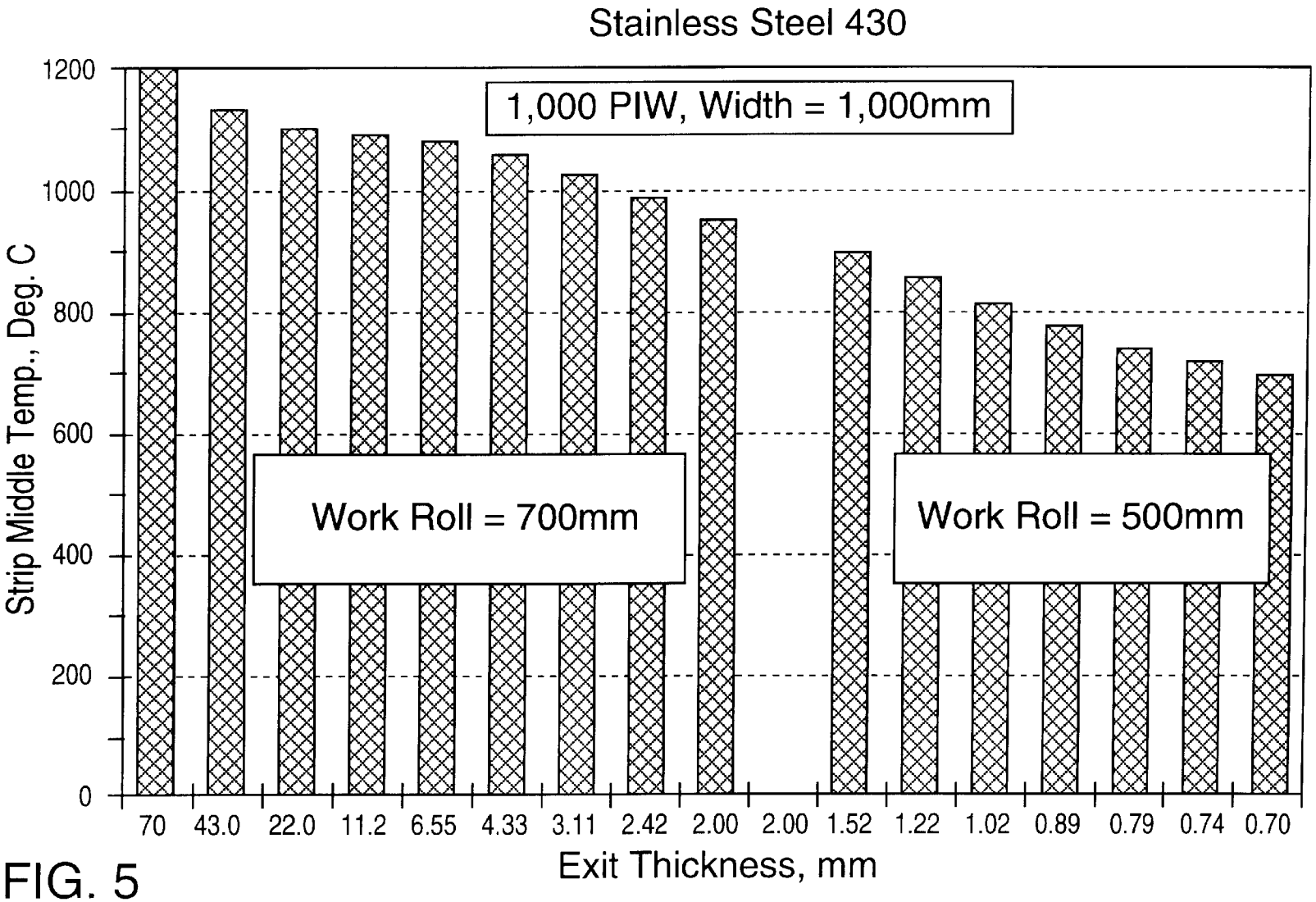
FIG. 5 is a graph showing exit thickness versus strip metal temperature of stainless steel 430 (AISI 430) in the roughing mill and the finishing mill of the present invention.
Figure 6:
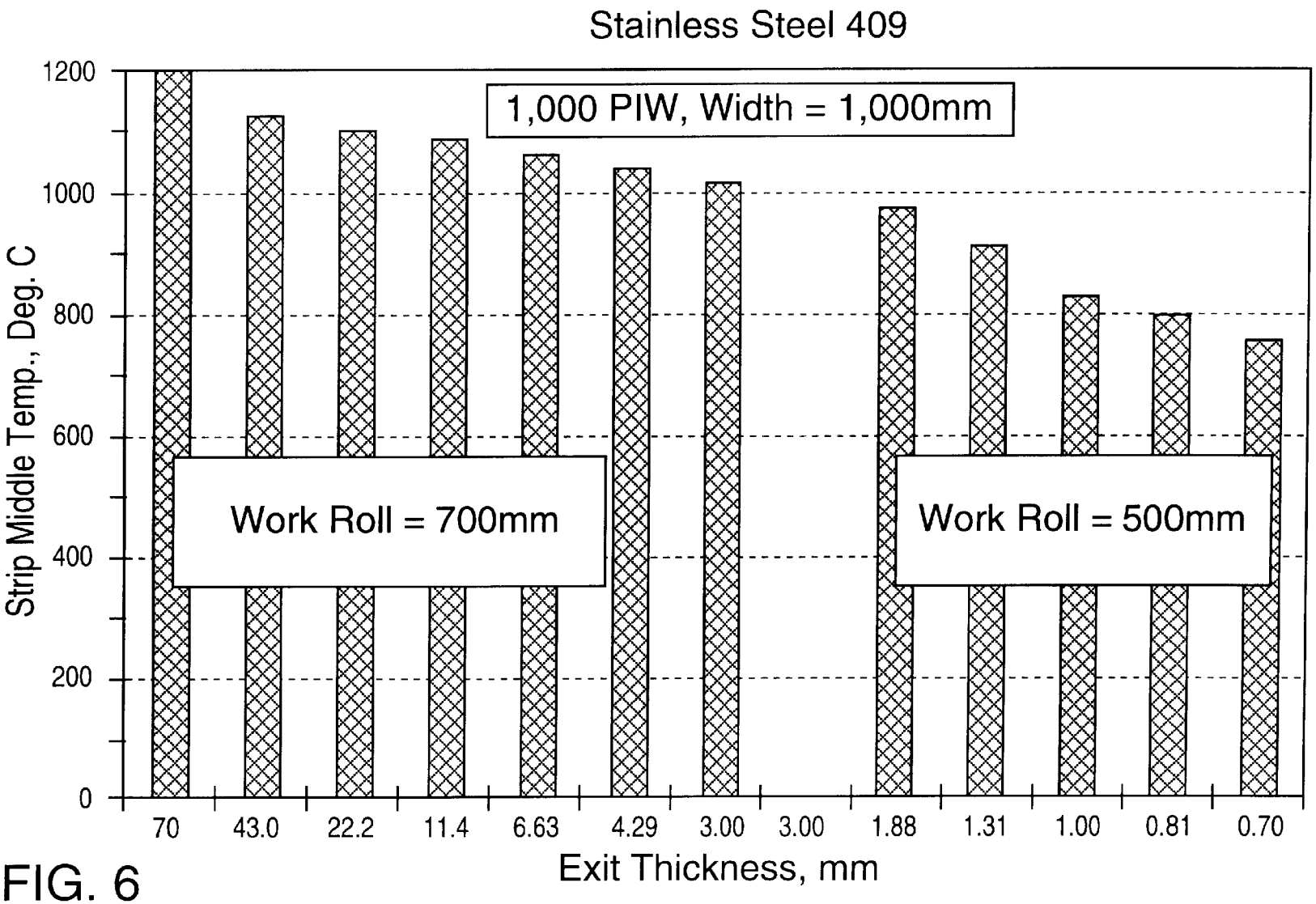
FIG. 6 is a graph showing exit thickness versus strip metal temperature of stainless steel 409 (AISI 409) in the roughing mill and finishing mill of the present invention.

FIGS. 4 through 6 illustrates the temperature of the metal strip during rolling in a roughing reversing mill and a thin strip mill. These figures also illustrate the importance of temperature and temperature control in the roughing reversing mill and the thin strip mill. For example, FIG. 4 is a graph of exit thickness versus strip middle temperature for stainless steel 304 (AISI 304—an austenitic stainless steel) in both a reversing roughing mill and a thin strip mill. The strip middle temperature in FIGS. 4–6 is the temperature measured at the midpoint of the length of metal strip. The steel used had a width of 1,000 mm and a strength of 1,000 PIW (pounds per inch of width).

It is apparent from FIG. 4 that the roughing rolling takes place between 950 and 1200° C. while the finishing rolling takes place at about 650 to 830° C. for AISI 304 steel. Temperatures of about 650 and 830° C. for finishing were possible because of the re-heating of the steel in the second furnace prior to rolling in the thin strip mill. As a result, a finished product with the desired dimensions and metallurgical properties was obtained.

FIG. 5 is a graph of exit thickness versus strip middle temperature for stainless steel 430 (AISI 430—a ferritic stainless steel) for rolling in both a roughing mill, for example a Steckel mill, and a thin strip mill. The strip middle temperature is the same as described for FIG. 4. The steel used had a width of 1,000 mm and a strength of 1,000 PIW (pounds per inch of width). The temperature ranges for rolling of this ferritic stainless steel is higher than that for AISI 304.

As shown in the graph, the temperature range for rolling in the roughing reversing mill is between 960 to 1200° C. and the finishing rolling in the thin strip mill takes place in at a temperature of about 700 to 920° C. The metal slab was rolled in roughing reversing mill from 70 mm to 2.00 mm in nine passes. The resultant 2.00 mm thick metal strip was rolled in the thin strip mill down to 0.70 mm in seven passes. Temperatures of about 700 to 920° C. for finishing were possible because of the re-heating of the steel in the second furnace prior to rolling in the thin strip mill. Again, as a result, a finished product with the desired dimensions and metallurgical properties was obtained.

Likewise, for the stainless steel 409 (AISI 409—a ferritic stainless steel) as shown in FIG. 6, the temperatures of rolling in the roughing reversing mill and thin strip mill are slightly elevated as compared to the temperatures for austenitic stainless steel 304. The reason is because of the different properties of the ferritic steel as compared to the austenitic stainless steels.

Figure 7:
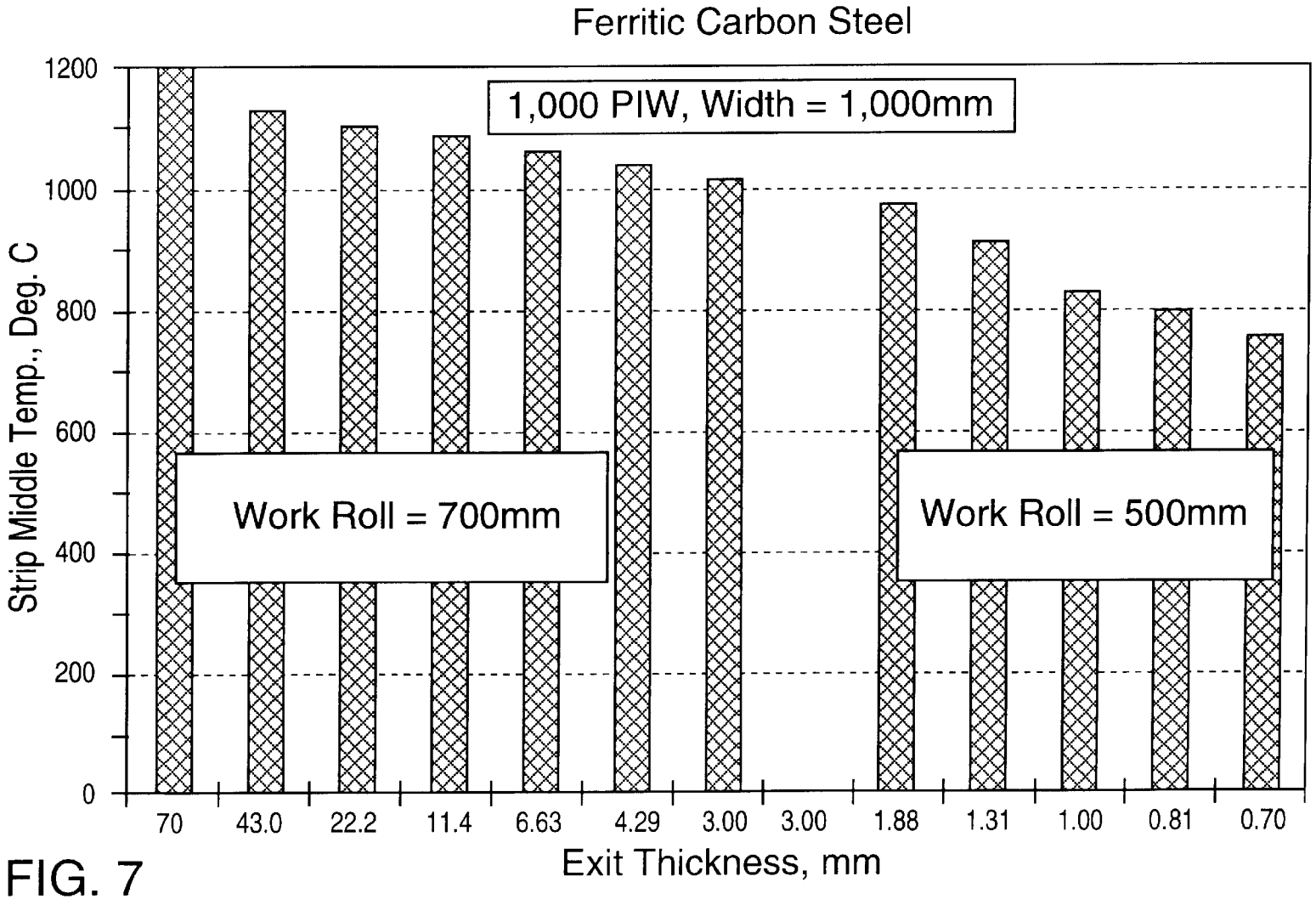
FIG. 7 is a graph showing exit thickness versus strip metal temperature of ferritic carbon steel in the roughing mill and finishing mill of the present invention.

FIG. 7 is a graph of exit thickness versus strip middle temperature for ferritic carbon steel for rolling in both a roughing mill and a thin strip mill. The strip middle temperature is the same as described for FIG. 4. The steel used had a width of 1,000 mm and a strength of 1,000 PIW (pounds per inch of width). The temperature ranges for rolling of this ferritic carbon steel is in the range of 1,200 to 1,000° C. for the roughing mill and 1,000 to 650° C. in the thin strip mill.

The method and apparatus of the present invention can efficiently produce thin metal strip between 0.4 and 1.2 mm.

While there has been illustrated and described several embodiments of the present invention, it will be apparent that various changes and modifications thereof will occur to those skilled in the art. It is intended in the appended claims to cover all such changes and modifications that fall within the true spirit and scope of the present invention.

What is claimed is:

1. A hot-rolling process for producing thin metal strip comprising:

heating a metal slab of an initial thickness to a first temperature suitable for rolling in a roughing mill;

rolling the resultant heated slab of said initial thickness in at least one roughing reversing mill stand having work rolls of a first diameter to produce a strip of an intermediate thickness;

re-heating said strip of said intermediate thickness to a second temperature suitable for working in a finishing mill, said second temperature being less than said first temperature; and rolling said strip of said intermediate thickness in a finishing mill having at least one finishing reversing mill stand having work rolls of a second diameter, less than the first diameter of said work rolls of said at least one roughing reversing mill stand, to produce a strip of a final thickness of about 0.4 mm to about 1.2 mm.

2. The process according to claim 1 wherein said first temperature and second temperature are temperatures suitable for working a metal selected from the group consisting of: ferritic carbon steel, ferritic stainless steel and austenitic stainless steel in said at least one roughing reversing mill stand and said at least one finishing reversing mill stand.

3. The process according to claim 1 wherein said first temperature is in the range of 1,000° C. to 1250° C.

4. The process according to claim 1 wherein said second temperature is the range of 850° C. to 1,000° C.

5. The process according to claim 1 wherein strip of said intermediate thickness has a thickness of about 1.5 mm to about 4 mm.

6. The process according to claim 1 wherein said diameter of said first work rolls is in the range of about 600 mm to about 800 mm.

7. The process according to claim 1 wherein said diameter of said second work rolls is in the range of about 300 mm to about 600 mm.

8. The process according to claim 1 further comprising rolling metal in said at least one roughing reversing mill stand and rolling metal in said at least one finishing reversing mill stand, by coil passing using colliers located proximate said mill stands.

9. The process according to claim 1 further comprising trimming said slab of an initial thickness in an edger after heating to a first temperature and before rolling in said at least one roughing reversing mill stand.

10. The process according to claim 1 further comprising shearing said strip of intermediate thickness after re-heating to a second temperature and before rolling in said at least one finishing reversing mill stand.

11. The process according to claim 1 further comprising descaling said slab of an initial thickness and cleaning said strip of an intermediate thickness prior to rolling in said at least one finishing reversing mill stand.

12. A hot-rolling process for producing thin metal strip comprising:

heating a metal slab of an initial thickness to a first temperature suitable for rolling in a roughing mill;

rolling the resultant heated slab of said initial thickness in at least one roughing reversing mill stand having work rolls of a first diameter to produce a strip of an intermediate thickness of about 1.5 mm to about 4 mm;

re-heating said strip of said intermediate thickness to a second temperature suitable for working in a finishing mill, said second temperature being less than said first temperature;

cleaning said strip of an intermediate thickness in a metal strip cleaning apparatus; and rolling said strip of said intermediate thickness in at least one finishing reversing mill stand having work rolls of a second diameter, less than the first diameter of said work rolls of said at least one roughing reversing mill stand, to produce a strip of a final thickness, wherein said strip produced is of a final thickness is about 0.4 to about 1.2 mm.

13. The process according to claim 12 wherein said first temperature and second temperature are temperatures suitable for working a metal selected from the group consisting of: ferritic carbon steel, ferritic stainless steel and austenitic stainless steel in said at least one roughing reversing mill stand and said at least one finishing reversing mill stand.

14. The process according to claim 12 wherein said first temperature is in the range of 1,000° C. to 1250.

15. The process according to claim 12 wherein said second temperature is the range of 850° C. to 1,000° C.

16. The process according to claim 12 wherein said diameter of said first work rolls is in the range of about 600 mm to about 800 mm.

17. The process according to claim 12 wherein said diameter of said second work rolls is in the range of about 300 mm to about 600 mm.

18. The process according to claim 12 wherein rolling to produce a strip of said intermediate thickness 1.5 mm to 4 mm thick is performed in 7 to 15 roll passes and wherein rolling to produce a strip of about 0.4 mm to about 1.2 mm thick is performed in 5 to 9 roll passes.

19. A hot-rolling process for producing thin metal strip comprising:

heating a metal slab of an initial thickness to a first temperature in the range of 1,000° C. to 1250° C.;

trimming said slab of an initial thickness in an edger;

rolling said slab of said initial thickness in at least one roughing reversing mill stand having work rolls with a diameter in the range of 600 mm to 800 mm to produce a strip of an intermediate thickness of 1.5 mm to 4 mm;

re-heating said strip of said intermediate thickness to a second temperature in the range of 850° C. to 1,000° C.;

cleaning said strip of said intermediate thickness;

shearing said strip;

rolling said strip of an intermediate thickness in at least one finishing reversing mill stand having work rolls with a diameter in the range of 300 mm to 600 mm; and rolling said strip of an intermediate thickness for last two rolling passes at a temperature in the range of 650 to 800° C., to obtain the desired metallurgical properties, said strip produced is a strip of a final thickness of about 0.4 to about 1.2 mm.

* * * * *